US007850274B1

(12) United States Patent
Chang et al.

(10) Patent No.: US 7,850,274 B1
(45) Date of Patent: Dec. 14, 2010

(54) PRINTERS AND METHODS TO REDUCE VAPOR EMISSIONS IN PRINTERS

(75) Inventors: Seongsik Chang, Santa Clara, CA (US); Omer Gila, Cupertino, CA (US); Michael H. Lee, San Jose, CA (US); Paul F. Matheson, San Bruno, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/771,822

(22) Filed: Apr. 30, 2010

(51) Int. Cl.
*B41J 29/377* (2006.01)

(52) U.S. Cl. ..... 347/18; 347/223

(58) Field of Classification Search ..... 347/18, 347/223

See application file for complete search history.

(56) References Cited

U.S. PATENT DOCUMENTS 6,643,220 B2 11/2003 Anderson et al.
2005/0093908 A1* 5/2005 Riou et al. ..... 347/18
2009/0035023 A1 2/2009 Thompson et al.
2009/0290897 A1 11/2009 Doshoda et al.

OTHER PUBLICATIONS

Lauren Barker, "Reducing Volatile Organic Compounds to Zero to Meet Future Industrial Environmental Standards," Graphic Communication, Cal Poly, Fall Quarter, 12 pages.
The Canadian Printing and Publications Industry, "Volatile Organic Compounds in Consumer and Commercial Products," retrieved from http://www.ec.gc.ca.nopp/voc/en/secP.cfm, on Apr. 13, 2010, 4 pages.

* cited by examiner

*Primary Examiner*—Huan H Tran

(57) ABSTRACT

Printers and methods to reduce vapor emissions in printers are disclosed. An example printer is described, including a fan to urge an airflow from a first printer portion, a duct to direct the airflow from the first printer portion and to substantially prevent adding air to the airflow, a condenser in communication with the duct, the condenser comprising a first condensing fin to condense oil in the airflow into a liquid, and an airflow reflection reducer associated with the condenser to reduce reflection of the airflow off of the first condenser fin.

15 Claims, 12 Drawing Sheets

PRINTERS AND METHODS TO REDUCE VAPOR EMISSIONS IN PRINTERS

BACKGROUND

Some printers and printing presses (hereinafter printers) use a condenser to remove heat and/or vapor(s) generated during operation. A condenser uses one or more temperature-controlled surfaces to affect the temperature of a fluid passing by the condenser. The fluid may then be re-circulated back into the printer to maintain an acceptable operating temperature of the printer.

DETAILED DESCRIPTION

Certain examples are shown in the above-identified figures and described in detail below. In describing these examples, like or identical reference numbers are used to identify the same or similar elements. Additionally, several examples have been described throughout this specification. Any features from any example may be included with, a replacement for, or otherwise combined with, other features from other examples. The figures are not necessarily to scale and certain features and certain views of the figures may be shown exaggerated in scale or in schematic for clarity and/or conciseness. Although the following discloses example systems and apparatus, it should be noted that such systems and apparatus are merely illustrative and should not be considered as limiting the teachings of this disclosure.

The example systems and apparatus described herein may be used to increase collection and/or reduce emission of vapor in, for example, a printer such as a printing press. Some example apparatus described herein include a duct to direct a mixture of air and oil vapor from a printer to a condenser. An airflow reflection reducer couples the duct to the condenser. The reducer operates to reduce airflow reflection from the condenser to thereby improve the efficiency of the condensing process. The reducer also substantially reduces or prevents air from outside the duct and reducer from diluting the oil vapor in the mixture. Thus, the mixture has substantially the same concentration of oil vapor as when the mixture entered the duct from the printer. The example condenser then cools the mixture, causing at least a portion of the oil vapor within the mixture to condense into a liquid, which may then be collected. Collected oil may be recycled. Further, collecting the oil reduces the amount of oil vapor that may escape from the printer. Cooled air from the condenser is then re-circulated into the printer.

Figure 1:
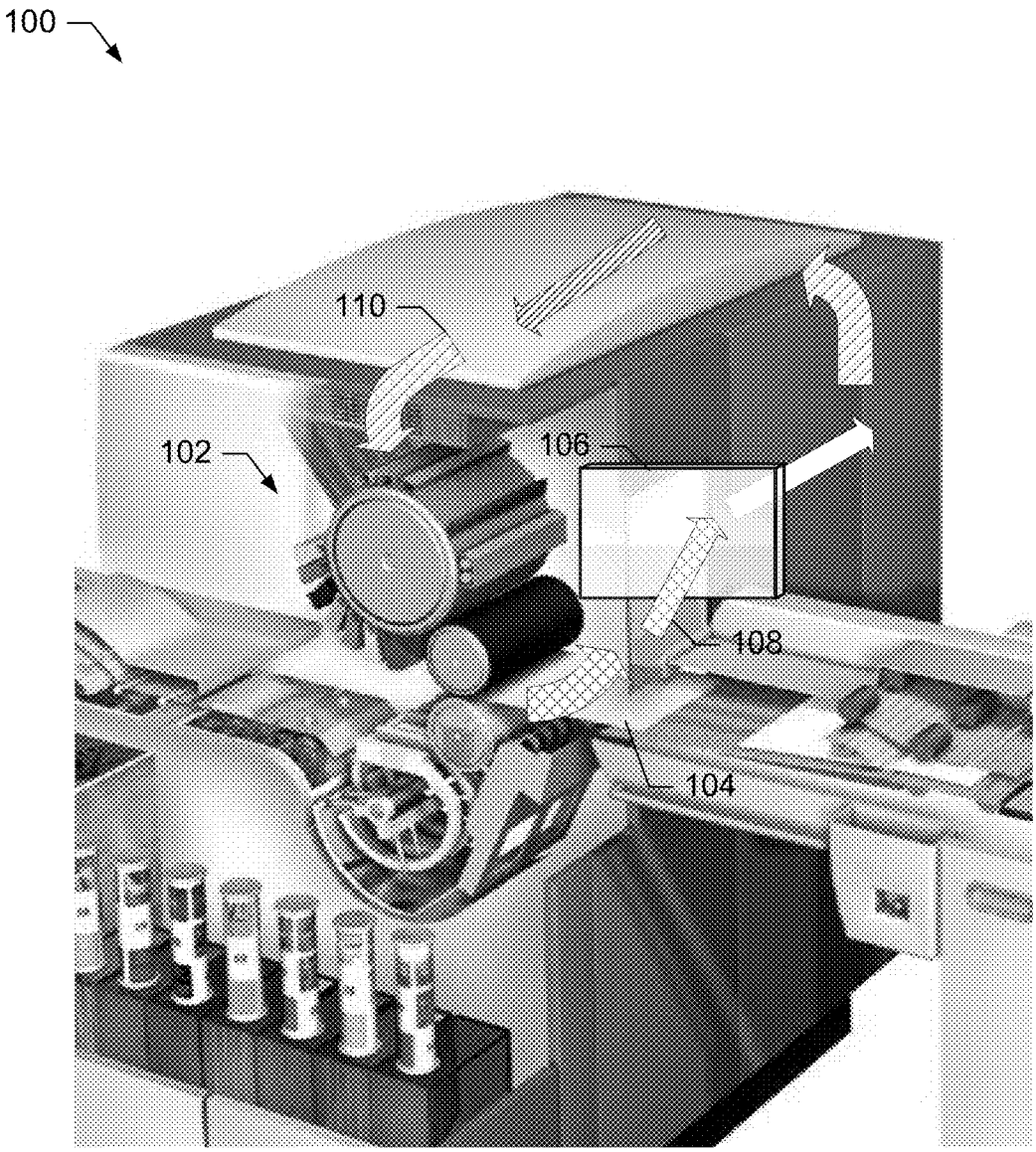
FIG. 1 depicts an example airflow cycle for a printer employing a condenser constructed in accordance with the teachings of this disclosure.

FIG. 1 depicts an example airflow cycle for a large format printer or printing press 100. The example printer 100 uses one or more inks that include a significant portion of oil. In some examples, the oil is a volatile organic compound (VOC) such as Isopar L. Emissions of many VOCs are regulated by government agencies and, thus, keeping emissions below regulation amounts is desirable. As the ink is transferred to an image transfer device 102 and to a print substrate 104 (e.g., paper), the oil vaporizes into the internal air of the printer 100.

Figure 2:
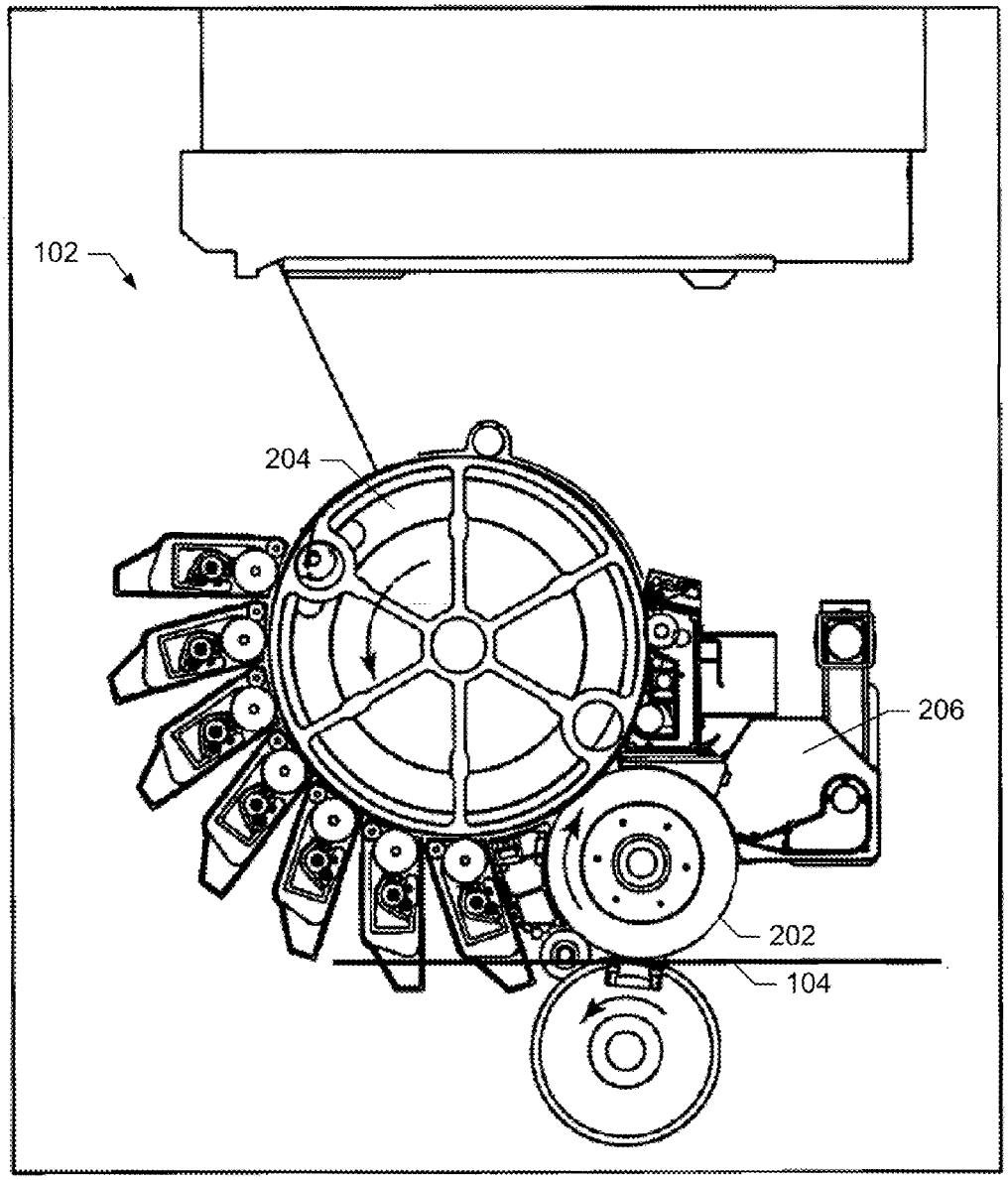
FIG. 2 depicts the example image transfer device of FIG. 1.

FIG. 2 depicts the example image transfer device 102 of FIG. 1 in greater detail. The example transfer device 102 includes a transfer member 202. The transfer member 202, also known as a blanket, receives an image of ink from a drum 204. The transfer member 202 rotates to apply the ink image to a print substrate 104 such as paper. As mentioned above, oil from the ink vaporizes into the air near the transfer member 202. A hood 206 captures hot internal press air, including the vaporized oil, and urges (e.g., via a blower) the hot air away from the image transfer device 102 to be cleaned and/or re-circulated.

Returning to FIG. 1, a condenser 106, which may be coupled to the hood 206, cools hot air 108 from the image transfer device 102 and condenses a portion of the vaporized oil into liquid oil. The liquid oil is then collected for recycling. Cooled air 110, including any remaining oil vapors, is re-circulated back from the condenser 106 into the printer 100.

Figure 3:
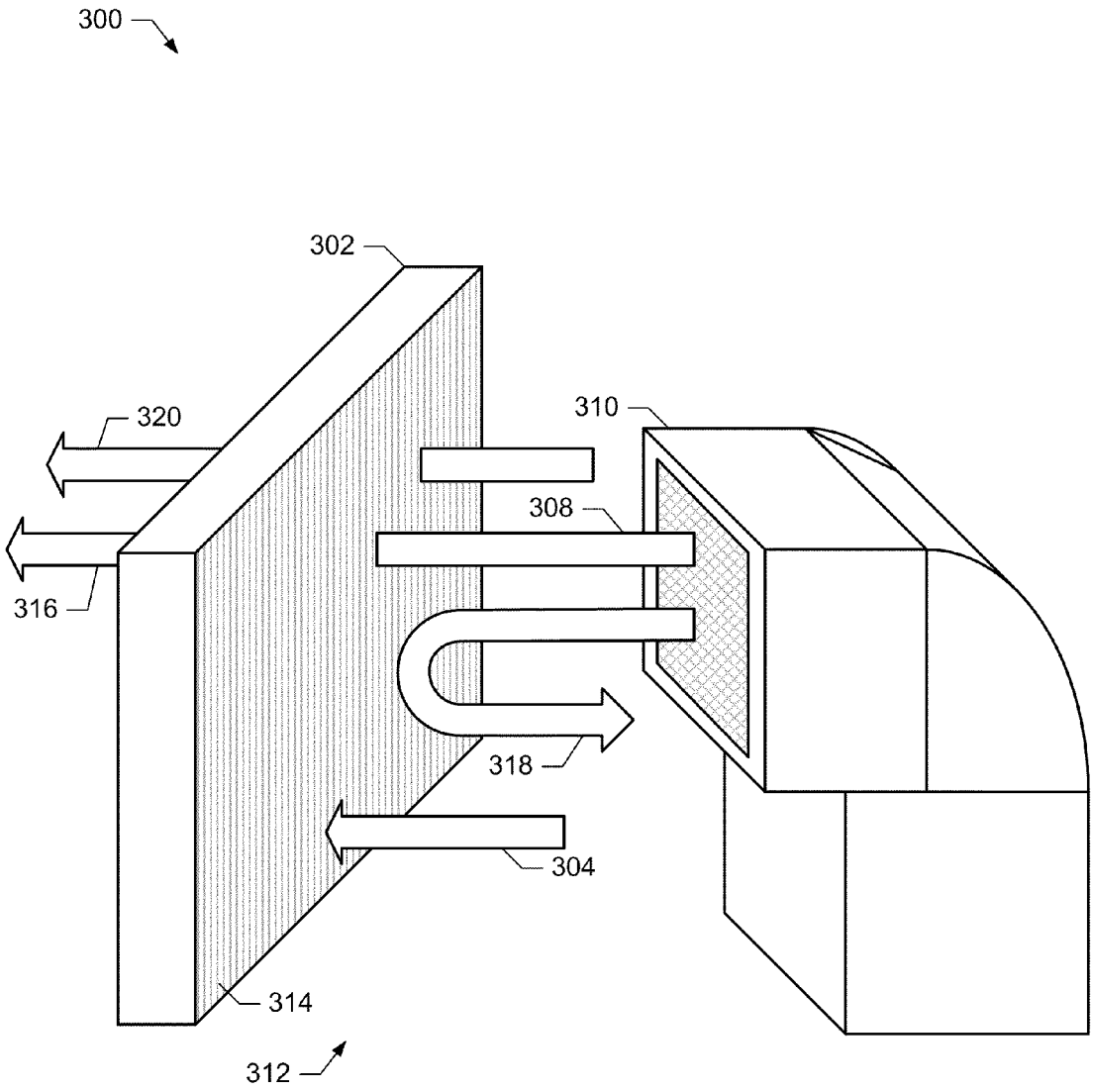
FIG. 3 illustrates a known condenser.

FIG. 3 depicts a known condenser configuration 300 in a printer. In the illustrated configuration 300 of FIG. 3, a condenser 302 cools air from a printer internal space and condenses oil vapor from the air. A first airflow 304 enters a printer. The first airflow 304 may include, for example, ambient air within the operating region of the internal printer airspace. A second airflow 308, received from a second portion 310 of the printer 100, includes oil vapor-laden air that may be directed from a portion of the press near the transfer member 202.

In the illustrated condenser configuration 300 of FIG. 3, the first and second airflows 304 and 308 mix in a chamber or cabinet 312 adjacent the condenser 302. The oil density of the air mixture in the cabinet 312 is less than the oil density of the second airflow 308 because the first airflow 304 has a lower concentration of oil vapor than the second airflow. Thus, when the first and second airflows 304 and 308 mix, the oil vapor is diluted by the first airflow 304.

The second airflow 308 is urged or blown at the condenser 302 (e.g., using a fan or blower). The condenser 302 includes a plurality of condensing fins 314 that cool passing air. A first portion 318 of the second airflow 308 passes through the condenser 302, which cools and reduces the vapor density of the first portion 316, and re-circulates through the printer 100. A reflected air 318 portion of the second airflow 308 reflects off of the condensing fins 314 and back into the cabinet 312. A second portion 320 of the air within the cabinet 312 also flows through the condenser 302. The reflected air 318, and the oil vapor contained therein, intermixes with the first airflow 304 within the cabinet 312. Thus, the concentration of oil vapor flowing through the condenser 302 is less than the concentration of oil vapor in the second airflow 308. Because the amount of oil vapor that condenses is based on the concentration of oil vapor in the mixture passing through the condenser 302, the reflection and the mixture of the first and second airflows 304 and 308 reduces the oil that is condensed to liquid by the condenser 302.

Figure 4:
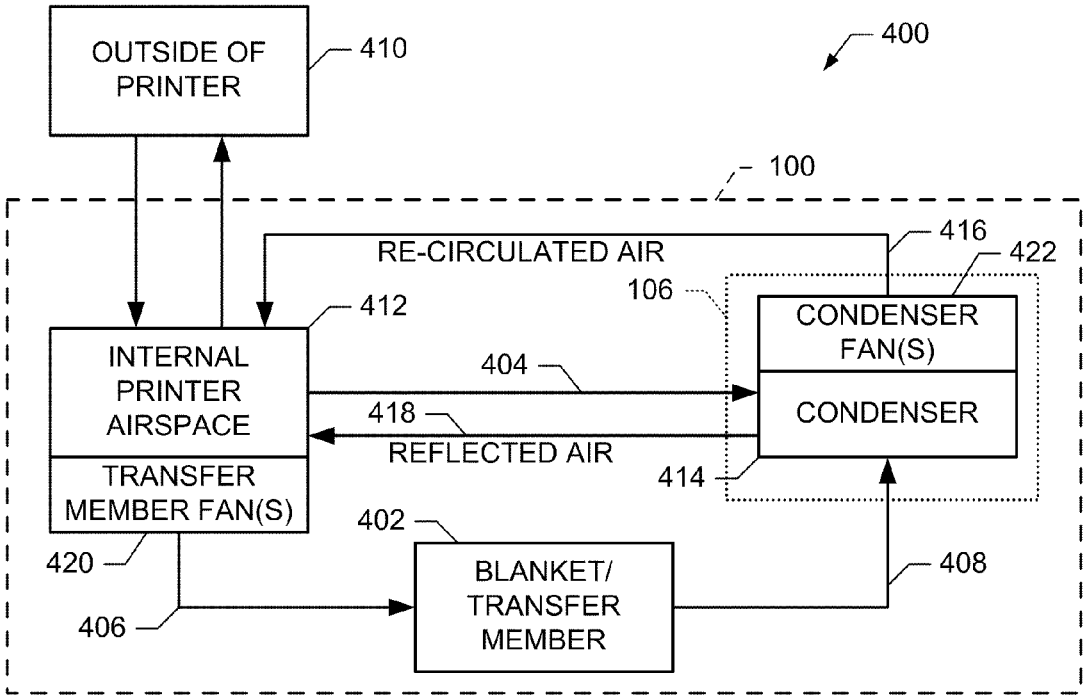
FIG. 4 depicts an airflow cycle for a known condenser.

FIG. 4 depicts an airflow cycle 400 for a known condenser configuration 300 in a large format printer or printing press. In the illustrated airflow cycle 400, air and/or a mixture of air and oil vapor travels between a transfer member 402 (e.g., an intermediate transfer member, a blanket), an internal airspace of a printer (e.g., press internal airspace 406), and a condenser assembly 106. The condenser assembly 106 includes a condenser 414 and a condenser fan 422. Additionally, air and/or oil vapor may be exchanged with an outside area 410 of the printer 100 via intake, exhaust, and/or leakage.

More specifically, an airflow 404 from the internal printer airspace 412 is urged toward the condenser 414. Additionally, an air and/or oil vapor mixture 406 is directed from the internal printer airspace 412 to the transfer member 402 by transfer member fan(s) 420. The transfer member 402 increases the oil vapor concentration of the received air due to vaporization of oil from the transfer member 402. A second air and oil vapor mixture 408 is urged (e.g., via a fan, not shown) from the transfer member 402 to the condenser 414. A portion of the second mixture 408 and the airflow 404 pass through the condenser 414, or are drawn by the condenser fan(s) 422, and mix. The air and oil vapor passing through the condenser 408 become a re-circulated airflow 416 that is re-circulated back into the internal printer airspace 412. However, a second portion (e.g., reflected air 418) of the second mixture 408 and the airflow 404 is reflected off of the condenser 414 and back into the internal printer airspace 412. The reflected air 418 increases the oil vapor concentration within the internal printer airspace 412.

The internal printer airspace 412 also exchanges air with the outside 410 of the printer 100. For example, air and/or oil vapor may leak or escape from the internal printer airspace 412. As the concentration of oil vapor in the internal printer airspace 412 increases, the amount of oil vapor that escapes from the printer 100 to the outside 410 increases. However, some types of oils (e.g., Isopar L) are considered VOCs, and leakage from the printer 100 is undesirable. As a result of the reflection of the reflected air 418, the air in the internal printer airspace 412 has an increased oil vapor concentration, which increases the leakage of oil vapor from the printer 100.

Figure 5:
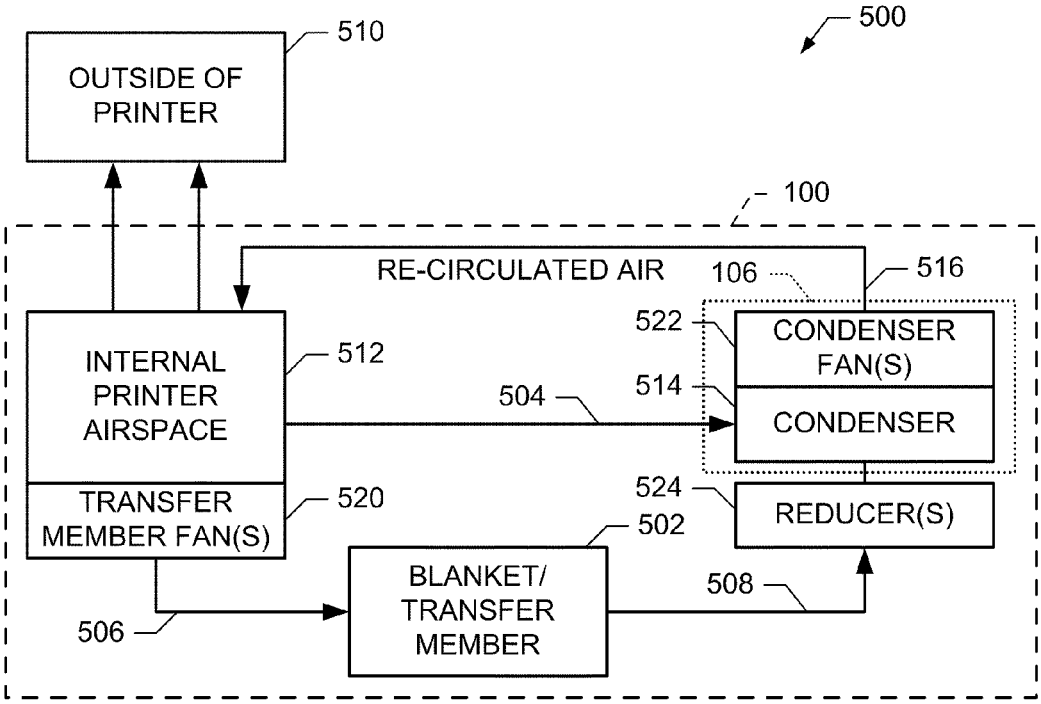
FIG. 5 depicts an example airflow cycle for an example condenser and airflow reflection reducer constructed in accordance with the teachings of this disclosure.

FIG. 5 depicts an example airflow cycle 500 for an example large format printer or printing press 506. As shown in FIG. 5, the printer 506 includes airflow reflection reducer(s) 524. The example printer 506 also includes an internal airspace 512, a transfer member 502 (e.g., a blanket), and a condenser assembly 106 associated with the reducer(s) 524. The condenser assembly 106 includes a condenser 514 and a condenser fan 522. The reducer(s) 524 function to reduce airflow reflections from the condenser assembly 106. Additionally, the printer 506 includes one or more transfer member fans 520. The transfer member fan 520 and the condenser fans 522 urge airflows through the airflow cycle 500. The airflow cycle 500 includes a first airflow 506 from the printer internal airspace 512 to the transfer member 502, a second airflow 508 from the transfer member 502 to the reducer 524, an ambient airflow 504 from the printer internal airspace 512 to the condenser 514, and a re-circulation airflow 516 from the condenser fan(s) 522 to the printer internal airspace 512.

As mentioned above, the reducer(s) 524 reduce airflow reflection from the condenser 514. Consequently, compared to the airflow cycle 400 of FIG. 4 and the known condenser configuration 300 of FIG. 3, the airflow cycle 500 exhibits reduced and/or no reflection airflow. As a result, the second airflow 508 that has the oil vapor-laden air is more effectively transmitted through the condenser 514 and less oil vapor is reflected back to the printer internal airspace 512. Thus, more oil vapor is collected at the condenser 514 as liquid, and less oil vapor is leaked to the outside of the printer 510. In some examples, the transfer member 502 is included within the printer internal airspace 512, thereby removing the airflow 506 as a distinct airflow.

Figure 6:
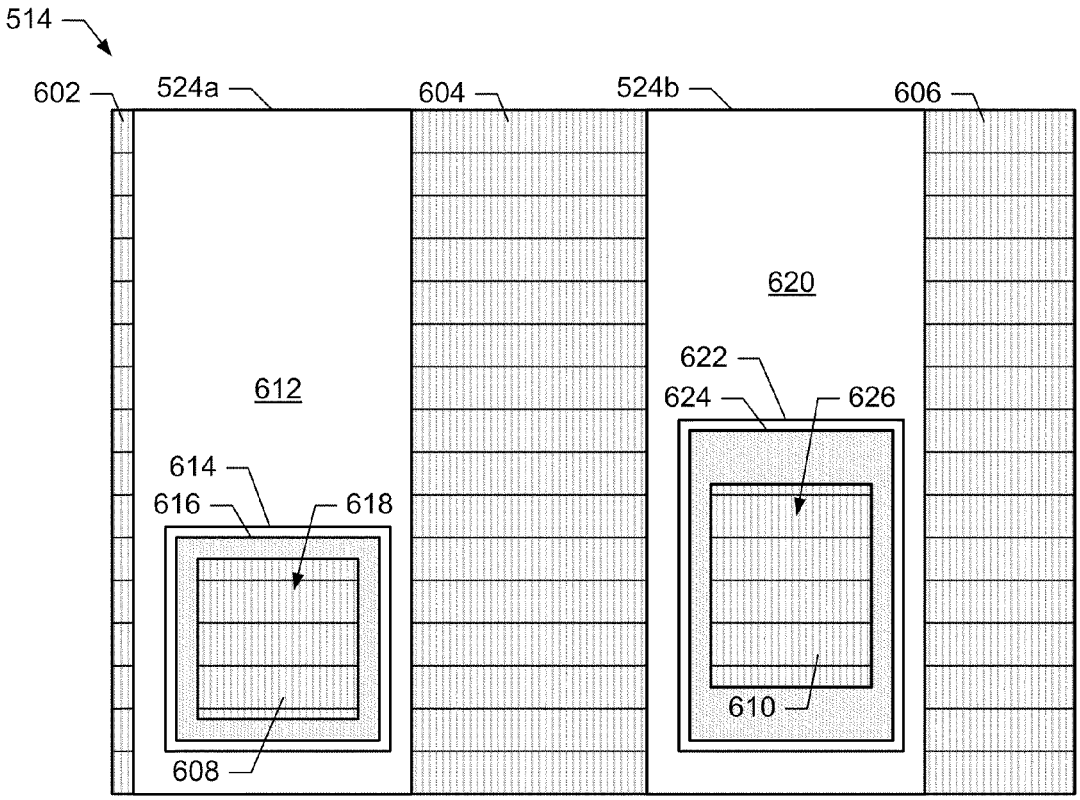
FIG. 6 is a front view of an example implementation of the condenser and airflow reflection reducers of FIG. 5.

FIG. 6 is a front view of example airflow reflection reducers 524*a* and 524*b* coupled to a condenser 514. The reducers 524*a* and 524*b* respectively receive air and oil vapor mixtures via ducts as described in more detail below. In some examples, the reducers 524*a* and 524*b* are in communication with ducts from regions around a transfer member or blanket (e.g., 202 of FIG. 2). The reducers 524*a* and 524*b* substantially reduce or prevent reflections of air and oil vapor mixtures directed to the portions of the condenser 514 covered by the reducers 524*a* and 524*b*. The air and oil mixtures are directed via the ducts into the reducers 524*a* and 524*b*. In some examples, the condenser 514 is substantially completely covered by reducers 524*a* and 524*b*. In yet other examples, all or a portion of the condenser 514 is covered by a single reducer 524*a* that receives an air/oil mixture via a single duct.

The condenser 514 includes a plurality of condensing fins 602, 604, 606, 608, and 610. As illustrated in FIG. 6, the example condensing fins 602-610 are oriented in horizontal rows of parallel vertical fins. The condensing fins 602-610 may additionally or alternatively be arranged horizontally in columns. Other orientations may also be used. Whether accomplished via orientation or geometry, increasing the total surface area for the condensing fins 602-610 increases the oil vapor collected by the condenser 514. In some examples, the reducers 524*a* and 524*b* define internal spaces. In such examples, the condensing fins 608 and 610 within the reducers 524*a* and 524*b* may extend into the internal spaces within the reducers 524*a* and 524*b* to increase the surface area exposed to the air and oil vapor mixture(s), thereby increasing the liquid oil collected.

In general, the reducers 524*a* and 524*b* are attached to the condenser 514 to increase a proportion of air and oil mixture from the duct inlet 604 that flows through the condenser 514 and to decrease or eliminate a proportion of the air and oil mixture from the duct inlet 604 that escapes without flowing through the condenser 514. In particular, the example reducer 524*a* includes a cover 612 and a duct inlet 614. The example cover 612 is a rectangular-shaped box having one face open to the condenser 514 and at least a portion of another face open to the duct inlet 614. The sides of the cover 612 are pressed or fit to the condenser fins 608 such that airflow is restricted or prevented between the space within the cover 612 and the space outside the cover 612. The example duct inlet 614 extends from the cover 612 opposite the condenser 514 and includes a seal 616. The seal 616 receives a first duct and substantially seals air from outside the reducer 524*a* from mixing with the air and oil mixture entering a receptacle or opening 618. The receptacle 618 substantially aligns with a corresponding opening in the first duct coupled to the duct inlet 614 and receives an air and oil mixture from the first duct. The example reducer 524*b* is similar to the reducer 524*a*, but has a differently-shaped cover 620, duct inlet 622, and seal 624. The reducer 524*b* is also pressed or fit to the condenser fins 610 so that airflow between the inside and the outside of the reducer 524*b* is limited. The seal 624 receives a second duct and substantially seals air from outside the reducer 524*b* from mixing with the air and oil mixture entering a receptacle or opening 626 in the duct inlet 622. By preventing additional air from diluting the oil vapor, the reducers 524*a* and 524*b* and duct(s) substantially preserve the concentration of oil vapor in the mixture and increase condensation of the oil vapor.

As an air and oil mixture enters the example duct inlet 614 on the reducer 524*a*, the mixture is urged toward the condenser fins 508. As illustrated with reference to the known condenser configuration 300 of FIG. 3, a portion of the mixture may initially reflect off of the condenser fins 508. However, the cover 612 facilitates redirection of reflected airflow toward the condenser 514. Thus, in contrast to the known condenser configuration 300, any reflected mixture is confined to and may only disperse within the cover 612 of the reducer 524*a*. Continued flow of air and oil mixture into the duct inlet 614 of the reducer 524*a* reduces or prevents reflected mixture from exiting via the duct inlet 614. Therefore, any reflected mixture is forced back at the condenser 514 and flows through the condenser fins 608 covered by the reducer 524*a*, where the mixture is cooled and oil vapor is condensed into liquid.

The example condenser 514 also includes one or more condenser fins 602, 604, and 606 that are not enclosed or covered by the reducers 524*a* and 524*b*. Instead, the condenser fins 602-606 allow air from the internal printer airspace 512 and/or a chamber or cabinet outside of the reducers 524*a* and 524*b* to pass through the condenser 514 (e.g., to control the temperature of the printer).

Figure 7:
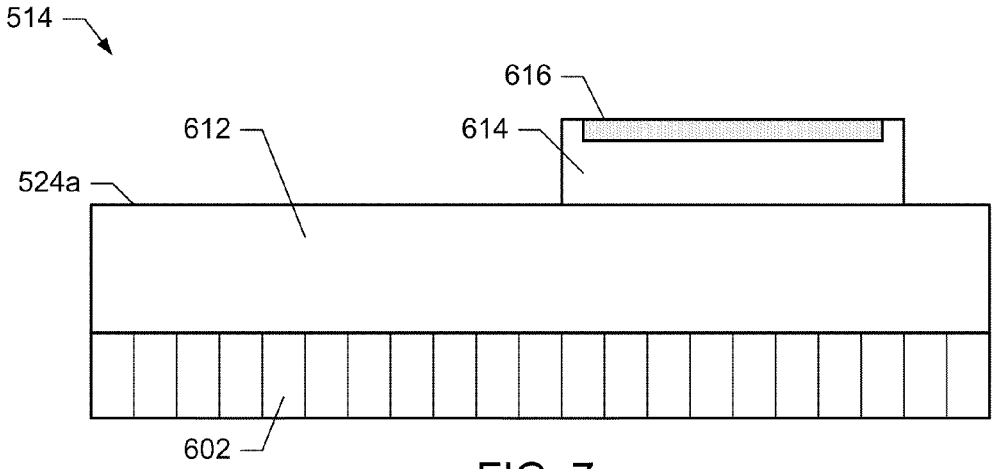
FIG. 7 is a side view of one of the example airflow reflection reducers and condenser fins of FIG. 6.

FIG. 7 is a profile view of one of the example reducers 524*a* coupled to the condenser 514 of FIG. 6. As discussed above, the example reducer 524*a* includes a cover 612 and a duct inlet 614. The duct inlet 614 is sealingly coupled to a duct as described in more detail below. The duct inlet 614 receives an air and oil vapor mixture via the duct and directs the air into the cover 612 and toward the condenser 514, while preventing additional air from outside of the reducer 524*a* (e.g., a chamber or cabinet) from intermixing with and/or diluting the mixture.

Figure 8:
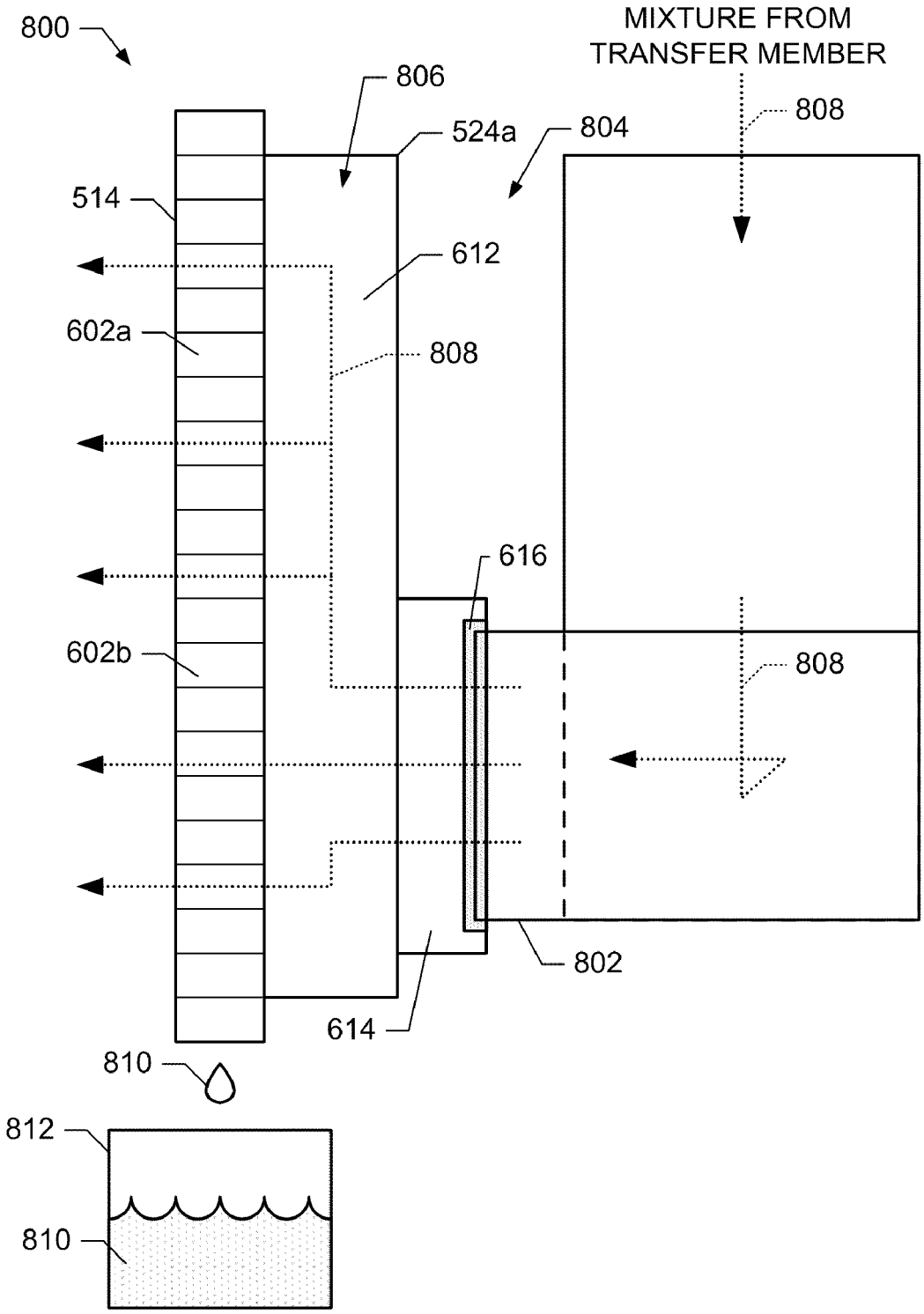
FIG. 8 is a side view of an example duct, reducer, and condenser to reduce airflow reflection off of a condenser fin.

FIG. 8 is a profile view of an example duct and reducer configuration 800 to reduce an airflow reflection off of a condenser 514. The example configuration 800 illustrates a duct 802 coupled to a reducer 524*a*. The reducer 524*a* includes a cover 612 and a duct inlet 614 including a seal 616. The duct 802 is coupled to the seal 616, which substantially reduces or prevents intermixing of air and oil vapor mixture 808 within the duct 802 and/or the reducer 524*a* with ambient air in a chamber or cabinet airspace 804 outside the duct 802. The cover 612 and the condenser 514 also define a volume 806 between the cover 612 and the condenser 514.

The duct 802 directs an air and oil vapor mixture 808 from, for example, a transfer member of an imaging or printing device (e.g., the printer 100 of FIG. 1). The mixture 808 is urged through the duct 802 and the duct inlet 614 into the cover 612 of the airflow reflection reducer 524*a*. The mixture 808 disperses to fill the volume 806 between the cover 612 and the condenser 514. The cover 612 is sealed to a portion of the condenser 514 to prevent ambient air from the cabinet 804 from entering the cover 612 around one or more condenser fins 602*a* and 602*b* on the condenser 514, thereby preventing intermixing and/or dilution of the air and oil vapor mixture 808 within the cover 612.

The mixture 808 passes through the condenser 514 by passing around the condensing fins 602*a* and 602*b* on the condenser 514. The condensing fins 602*a* and 602*b* are kept at a relatively cold temperature. The condensing fins 602*a* and 602*b* cool the passing mixture 808, which causes the oil vapor in the mixture 808 to condense into liquid oil 810. The liquid oil 810 may then drip into a collecting pan 812 for collection and/or recycling. As the temperature of the condensing fins 602*a* and 602*b* decreases, more oil vapor condenses into liquid and less oil vapor is re-circulated into the press internal airspace. In some examples, the condensing fins 602*a* and 602*b* are cooled to less than about 6 degrees Celsius. In some such examples, the condensing fins 602*a* and 602*b* may be cooled to 1 degree Celsius or less. However, if the temperature of the condensing fins 602*a* and 602*b* is 0 degrees Celsius or less, water vapor in the mixture 808 may condense and freeze onto the condensing fins 602*a* and 602*b*, which may then reduce the effectiveness of the condensing fins by reducing heat transfer.

Figure 9:
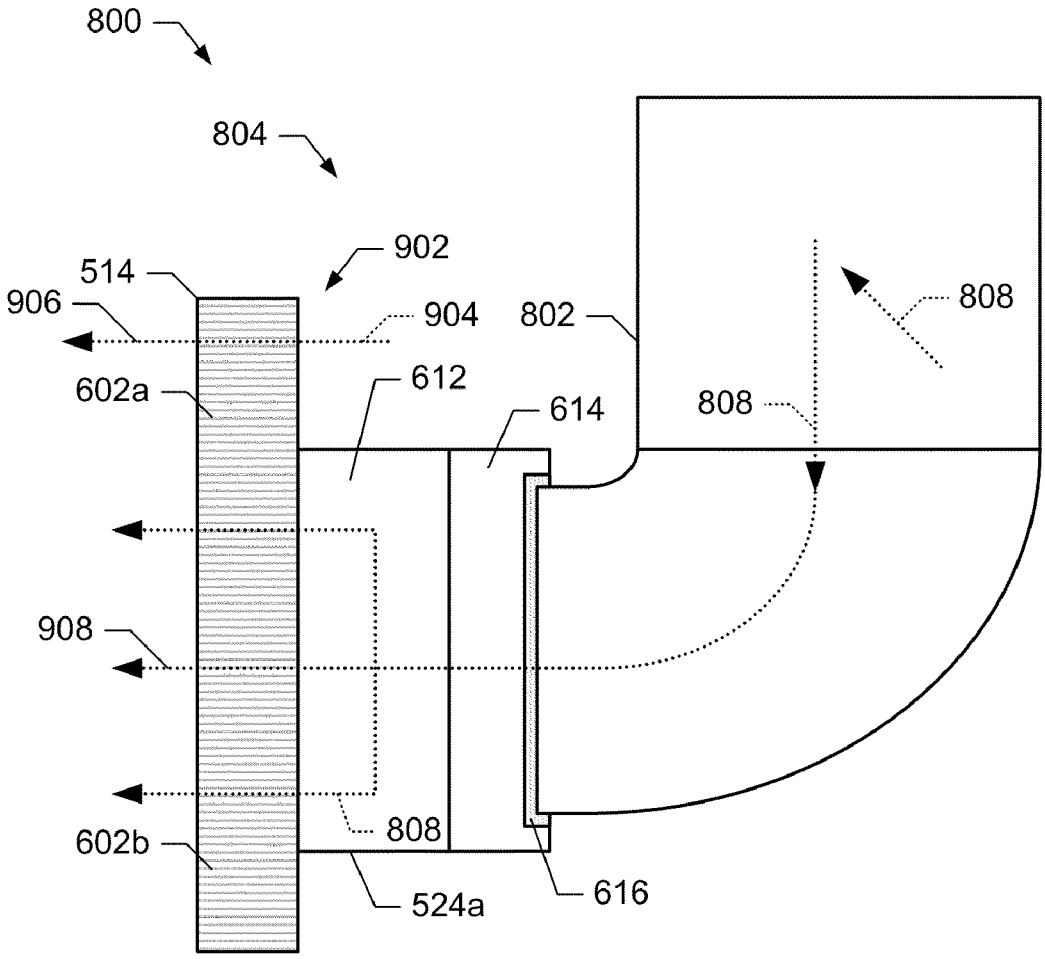
FIG. 9 is a top view of the example duct, reducer, and condenser of FIG. 8.

FIG. 9 is a top view of the example duct and reducer configuration 800 of FIG. 8. As described above, the duct 802 is coupled to the duct inlet 614 via the seal 616. The duct 802 directs the air and oil vapor mixture 808 to the duct inlet 614 and into the cover 612 of the airflow reflection reducer 524*a*. Within the cover 612, the mixture 808 disperses and passes through the condenser 514. An outside area 902 of the condenser 514 allows ambient air 904 within the cabinet 804 to pass through the condenser 514. The condenser fins 602*a* and 602*b* cool the ambient air 904 that passes through the condenser 514. After flowing through the condenser 514, cooled ambient air 906 and re-circulated mixture 908 combine and re-circulate to the printer. Thus, while mixing ambient air with the oil vapor mixture is avoided on the input side of the condenser 514, it is permitted downstream of the condenser 514.

Figure 10:
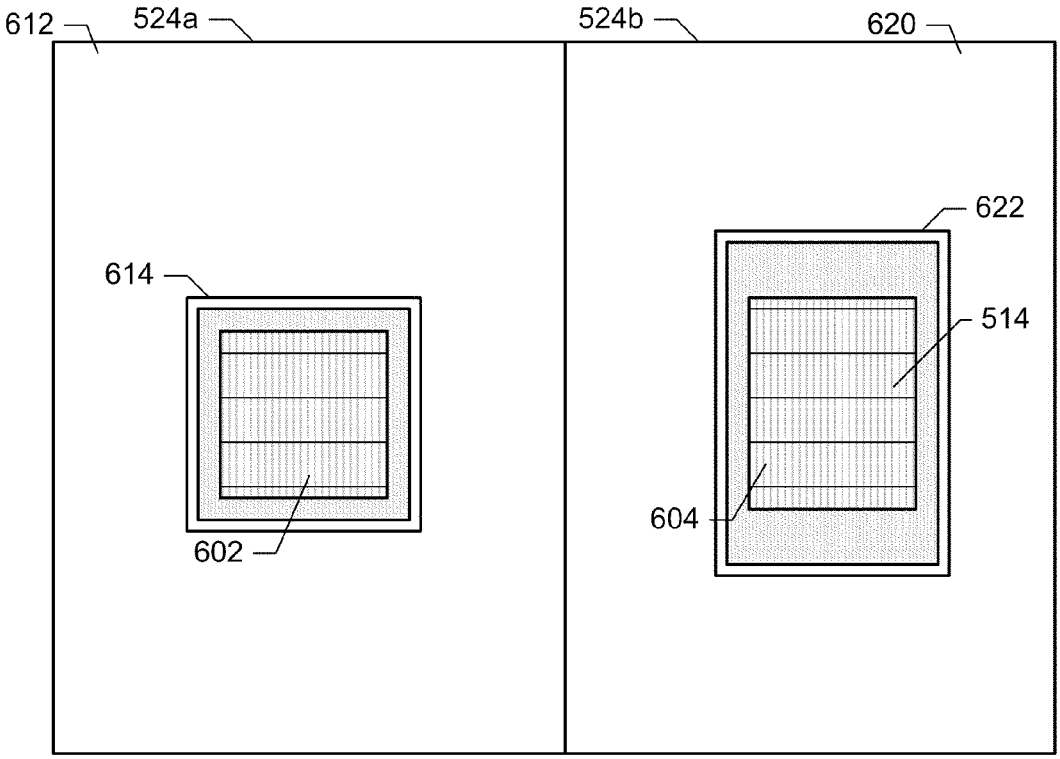
FIG. 10 is a front view of another example implementation of the condenser and reducers of FIG. 5.

FIG. 10 is a front view of example airflow reflection reducers 524*a* and 524*b* coupled to a condenser 514. In this example, the condenser 514 is substantially covered by the reducers 524*a* and 524*b*. The reducer 524*a* includes a cover 612 and a duct inlet 614. The duct inlet 614 may be coupled to a first duct to direct a first air and oil vapor mixture through the condenser 514. Similarly, the reducer 524*b* includes a cover 620 and a duct inlet 622. The duct inlet 622 may be coupled to a second duct to direct a second air and oil vapor mixture through the condenser 514. In the example of FIG. 10, substantially less ambient air (as compared to FIG. 6) passes through the condenser 514 because the reducers 524*a* and 524*b* cover all or substantially all of the condenser fins 602-610 of the condenser 514. By contrast, in FIG. 6, portions 602, 604, and 606 of the condenser 514 are not covered by the reducers 524*a* and 524*b*.

Figure 11:
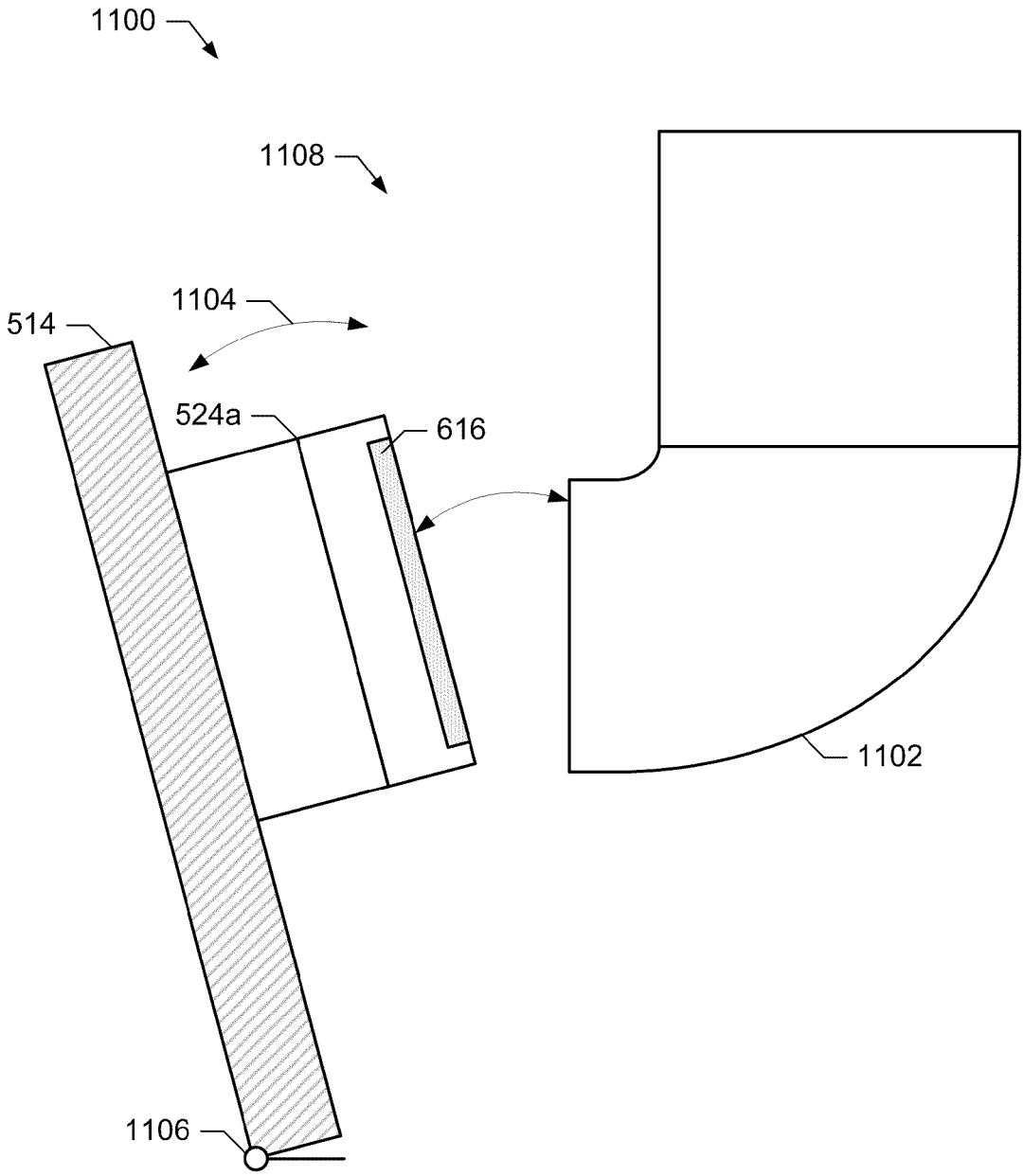
FIG. 11 is a top view of the example duct, reducer, and condenser implementation of FIG. 5.

FIG. 11 is a top view of an example duct and reducer configuration 1100 where a reducer 524*a* and a condenser 514 engage and disengage a duct 1102 based on a hinged movement 1104. In the illustrated configuration 1100, the condenser 514 is coupled to a hinge 1106, which permits the hinged movement 1104 of the condenser 514 and the attached reducer 524*a*. For example, the condenser 514 may be attached to a door that may be opened to provide access to a cabinet area 1108. When the door is opened as illustrated in FIG. 11, the reducer 524*a* decouples from the duct 1102. When the door is closed, a seal 616 on the reducer 524*a* couples the reducer 524*a* to the duct 1102 to reduce or prevent additional air from diluting oil vapor inside of the duct 1102 and/or the reducer 524*a* as described above.

Figure 12:
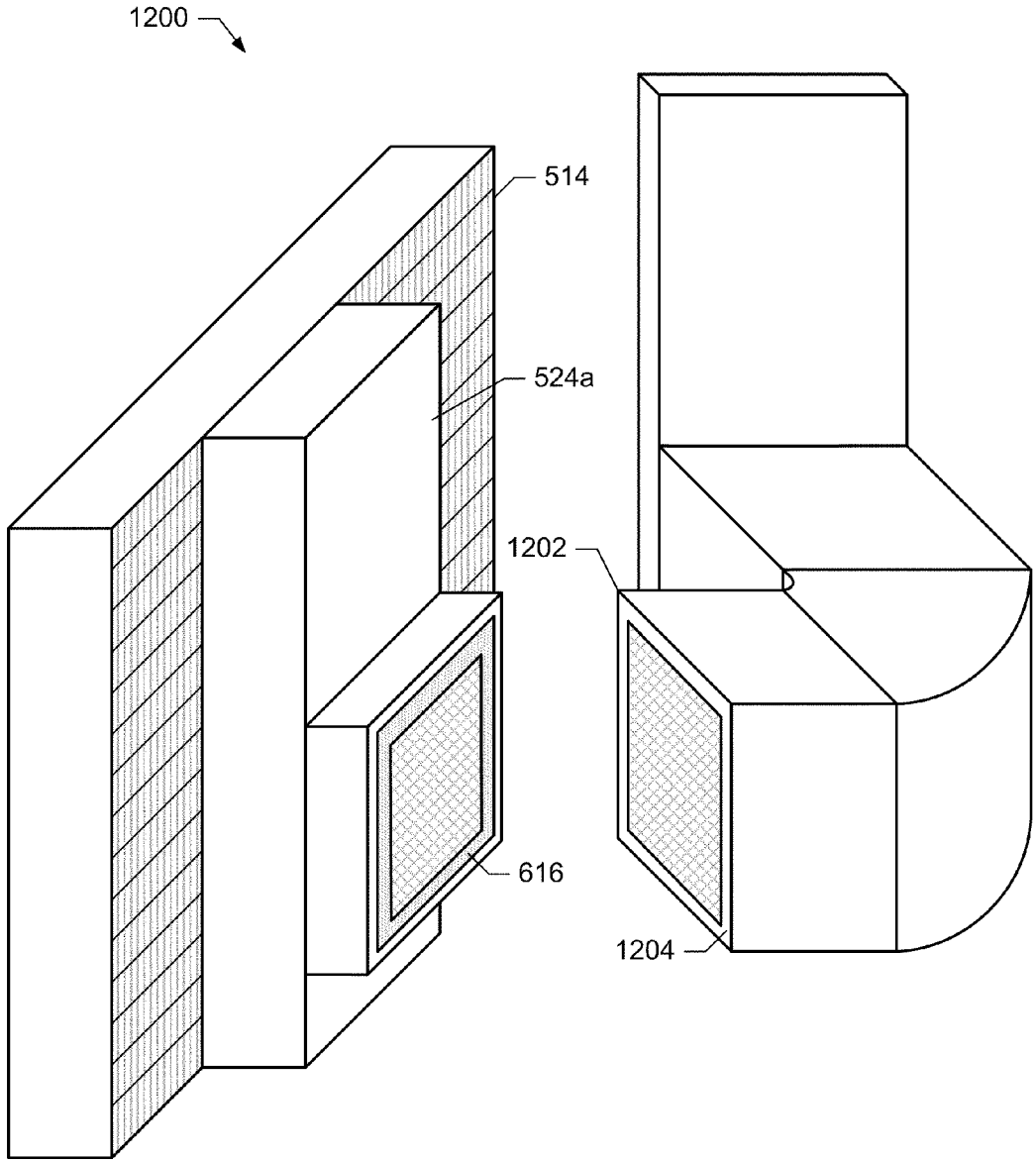
FIG. 12 is an isometric view of another example duct, condenser, and reducer constructed in accordance with the teachings of this disclosure.

FIG. 12 is an isometric view of another example duct and reducer configuration 1200. The example configuration 1200 includes a condenser 514, a reducer 524*a*, and a duct 1202. The reducer 524*a* and the duct 1202 are shown uncoupled in FIG. 12 to illustrate the respective configurations of each. The duct 1202 and a seal 616 on the reducer 524*a* are sized and shaped such that an outlet face 1204 of the duct 1202 fits into the seal 616.

The examples described herein may be adapted to use many different geometries. For instance, while the example covers 612 and 620 illustrated in FIGS. 6-12 are rectangular in geometry, other geometries may be used to implement the example reducers 524. In the illustrated examples, the rectangular covers 612 and 620 may be easily fit to the condenser fins 602-610 in vertical and/or horizontal rows to reduce and/or prevent airflow between the inside and outside of the reducers 524. Additionally, other geometries may be used to implement the duct inlets 614 and 622 and/or the seals 616 and 622. For example, the duct inlets 614 and 662 and/or the seals 616 and 622 may have a cylindrical or other geometry to be coupled to a duct having a circular opening. The configurations of the covers 612 and 620 may be based on the level of communication between different portions of the condenser 514. For example, the covers 612 and 620 illustrated in FIG. 6 may be appropriate for condenser fins 602-610 that extend from the top to the bottom of the condenser 514.

Figure 13:
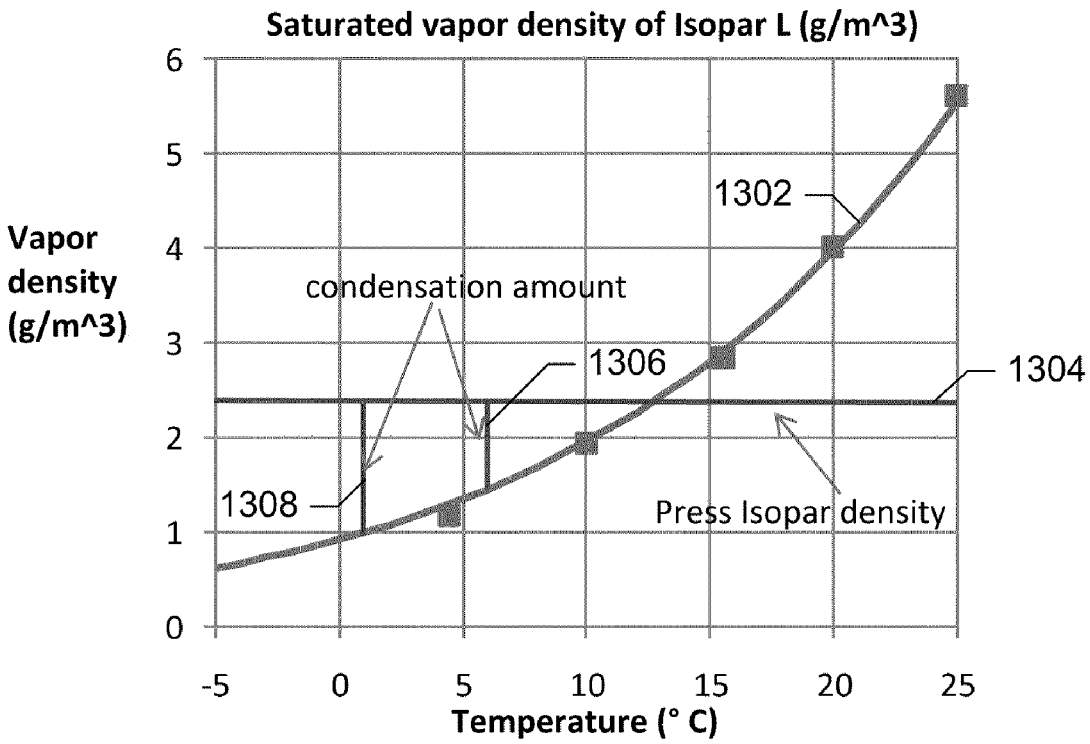
FIG. 13 depicts an example relationship between condensing fin temperature and the condensation rate of Isopar from an airflow in accordance with the teachings of this disclosure.

FIG. 13 is a graph 1300 depicting an example relationship curve 1302 between condensing fin temperature and condensation rate of Isopar L from an airflow. If the vapor density of an airflow at a particular temperature is higher than the curve 1302 at that temperature, the vapor in the airflow will condense until the vapor density approaches that of the curve 1302 at the given temperature. Thus, as illustrated in FIG. 13, a lower temperature will cause more condensation for a given vapor density in an airflow.

An example vapor density 1304 is also shown, which illustrates the vapor density in an example printer. At a condensing fin temperature of 6 degrees Celsius, a first amount 1306 of vapor will condense into liquid given sufficient time and interaction. At a lower condensing fin temperature of 1 degree Celsius, a second, larger amount 1308 of vapor will condense into a liquid given sufficient time and interaction.

While the temperature of the condensing fins determines the lower temperature to which the mixture passing the condensing fins cools, the length of time that a mixture is exposed to the condensing fins affects the mixture temperature in its approach toward the condensing fin temperature. The exposure time may thus be increased by increasing the length or surface area of the condensing fins.

Figure 14:
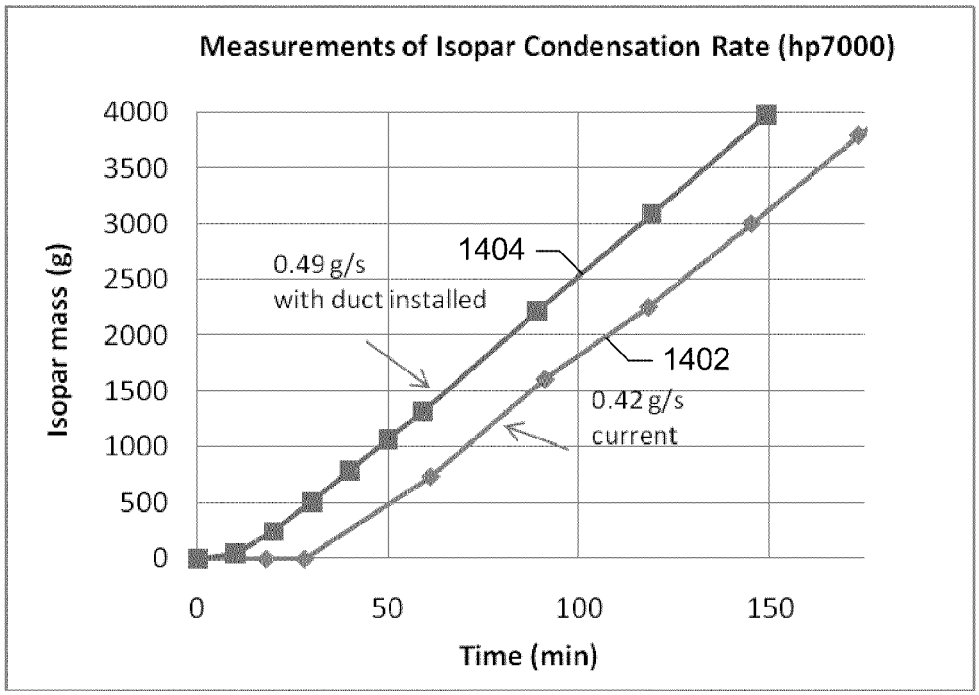
FIG. 14 depicts a comparison of example Isopar condensation rates between the known condenser of FIG. 4 and the example condensers and reducers described herein.

FIG. 14 depicts a comparison of example Isopar condensation rates between the known condenser configuration 400 of FIG. 4 and the example condenser configurations described herein. A first condensation rate 1402 illustrates a measured condensation rate of oil vapor from an air and oil vapor mixture using the known condenser configuration 400. A second condensation rate 1404 illustrates a measured condensation rate of oil vapor from an air and oil vapor mixture using the example reducers 524*a* and 524*b* of FIG. 6. As illustrated in FIG. 14, the condensation rate is increased by approximately 16%. Thus, the rate of Isopar L that is not captured is reduced from 0.34 g/s to 0.27 g/s, for approximately a 21% reduction.

Figure 15:
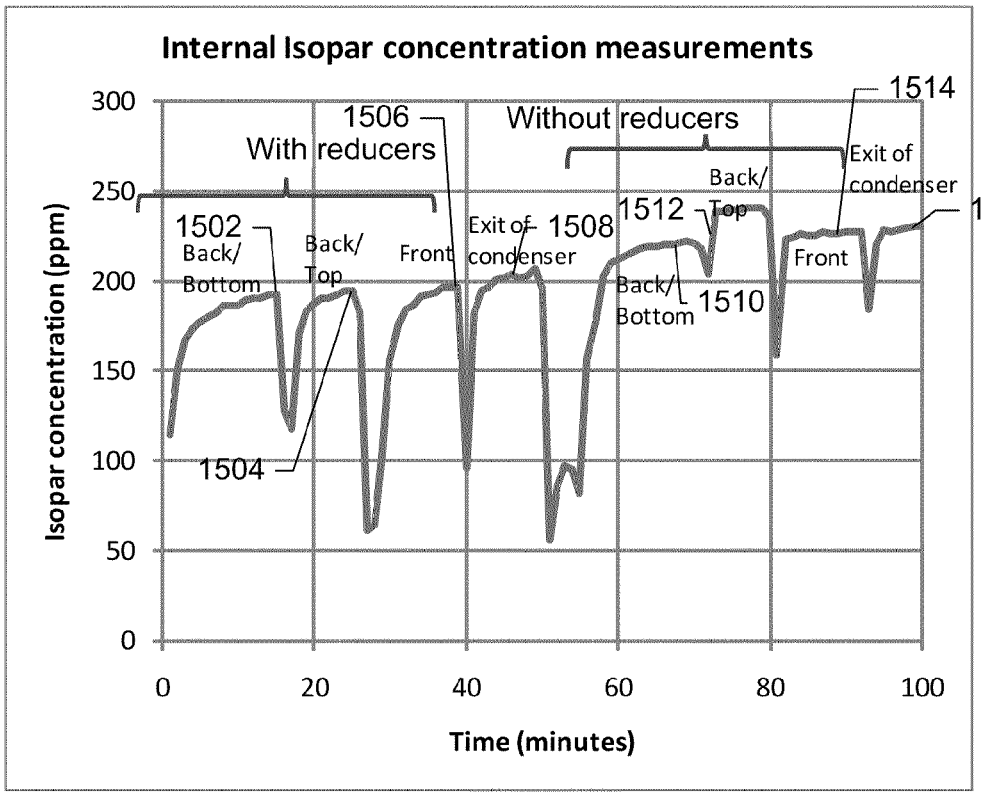
FIG. 15 depicts example Isopar concentration measurements of an example printer using the known condenser of FIG. 4 and the example condensers and reducers described herein.

FIG. 15 depicts example Isopar concentration measurements of an example printer using the known condenser configuration 400 of FIG. 4 and the example condenser configurations described herein. The first four measurements 1502, 1504, 1506, and 1508 represent the measured concentrations at different points in an internal printer airspace using the example reducers 524*a* and 524*b* of FIG. 6. The last four measurements 1510, 1512, 1514, and 1516 represent the measured concentrations at substantially the same points in the printer airspace using the known condenser configuration 400 of FIG. 4. As shown in FIG. 15, the measurements 1510-1516 have a higher concentration of Isopar L. As described above, the higher concentration of oil vapor within the reducers 524*a* and 524*b* causes more oil vapor to condense into liquid, thereby lowering the amount of oil vapor that is re-circulated to the printer.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A printer, comprising:

a fan to urge an airflow from a first printer portion;

a duct to direct the airflow from the first printer portion and to substantially prevent adding air to the airflow;

a condenser in communication with the duct, the condenser comprising a first condensing fin to condense oil in the airflow into a liquid; and an airflow reflection reducer associated with the condenser to reduce reflection of the airflow off of the first condenser fin.

2. A printer as defined in claim 1, wherein the reducer comprises:

a duct inlet to receive the airflow; and a cover to facilitate redirection of airflow toward the first condenser fin to the substantial exclusion of air outside the cover.

3. A printer as defined in claim 2, wherein the airflow comprises a mixture of oil and air.

4. A printer as defined in claim 3, wherein the oil comprises a volatile organic compound vapor.

5. A printer as defined in claim 2, wherein air outside the cover is urged toward a second condenser fin located outside the cover to control a temperature of the printer.

6. A printer as defined in claim 5, further comprising a condenser fan to urge the airflow toward the first condensing fin and to urge the air outside the cover toward a second condenser fin.

7. A printer as defined in claim 1, wherein the duct and the reducer reduce dilution of the airflow to increase condensation of oil.

8. A printer as defined in claim 1, wherein the first portion of the printer comprises a transfer member.

9. A printer as defined in claim 1, further comprising:

a second airflow reflection reducer; and a second duct to direct a second airflow from a second portion of the printer to the second reducer, the second reducer to direct the second airflow to a second portion of the condenser to the substantial exclusion of the first airflow and air outside the first and second reducers.

10. A printer as defined in claim 1, wherein the duct is in communication with the condenser via the reducer.

11. A method to reduce vapor emissions in a printer, comprising:

urging a mixture of oil and air from an printer into a duct;

directing the mixture through the duct toward an airflow reflection reducer;

condensing the oil from the mixture via a first portion of a condenser, wherein the reducer reduces reflection of the mixture off of the condenser; and controlling a temperature of the portion of the printer via a second portion of the condenser.

12. A method as defined in claim 11, wherein the duct and the airflow reflection reducer cooperate to reduce dilution of the mixture to increase condensation of the oil.

13. A method as defined in claim 11, wherein cooling the portion of the printer comprises urging air outside the duct toward a second condensing fin outside the duct via a condenser fan.

14. A method as defined in claim 11, wherein the oil comprises a volatile organic compound vapor.

15. A printing system, comprising:

an image transfer member;

a first fan to urge a first mixture of air and oil vapor from a first portion of the transfer member to the duct;

a first duct to direct the first mixture from the transfer member and to reduce addition of air to the first mixture;

a second fan to urge a second mixture of air and oil vapor from a second portion of the transfer member to the duct;

a second duct to direct the second mixture from the transfer member and to reduce addition of air to the second mixture;

a condenser to condense oil vapor in the first and second mixtures into a liquid, the condenser comprising a plurality of condensing fins;

a first airflow reflection reducer to reduce reflection of the first mixture off of the condenser fins; and a second airflow reflection reducer to reduce reflection of the second mixture off of the condenser fins, wherein the second mixture comprises more oil than the first mixture.

* * * * *